US006202718B1

(12) United States Patent
Innocenti

(10) Patent No.: US 6,202,718 B1
(45) Date of Patent: Mar. 20, 2001

(54) MULTI-FUNCTION TRANSPORTER FOR YARD DEBRIS

(76) Inventor: Bruno Innocenti, 5309 Hickory Ridge Ct., Virginia Beach, VA (US) 23455

( * ) Notice: Subject to any disclaimer, the term of this patent is extended or adjusted under 35 U.S.C. 154(b) by 0 days.

(21) Appl. No.: 09/454,920

(22) Filed: Dec. 3, 1999

(51) Int. Cl.[7] ..... B65B 1/04

(52) U.S. Cl. ..... 141/391; 294/1.1

(58) Field of Search ..... 141/231, 390, 141/391; 15/257.1, 257.3, 257.9; 229/115; 383/119; 294/1.1, 1.3

(56) References Cited

U.S. PATENT DOCUMENTS

| | | | | |
|---|---|---|---|---|
| D. 361,185 | | 8/1995 | Seiler et al. . | |
| D. 376,237 | | 12/1996 | Hayes, Sr. et al. . | |
| D. 386,865 | | 11/1997 | Storm . | |
| 3,312,263 | * | 4/1967 | Wahlstrom | 383/119 |
| 3,833,249 | * | 9/1974 | McKinney, II | 294/1.1 |
| 3,934,803 | | 1/1976 | Paulus, Jr. . | |
| 3,936,087 | | 2/1976 | Alexander . | |
| 3,942,832 | | 3/1976 | Haas, Jr. . | |
| 4,037,778 | | 7/1977 | Boyle . | |
| 4,117,983 | | 10/1978 | Browning . | |
| 4,191,324 | * | 3/1980 | Kitagawa | 229/108 |
| 4,269,348 | * | 5/1981 | Young | 229/115 |
| 4,434,829 | * | 3/1984 | Barnard | 383/34 |
| 4,521,043 | | 6/1985 | Wilsford . | |
| 4,693,504 | * | 9/1987 | Baker | 294/1.1 |
| 4,749,011 | | 6/1988 | Rylander . | |
| 4,760,982 | | 8/1988 | Cooke . | |
| 4,884,603 | | 12/1989 | Simpson . | |
| 4,940,200 | | 7/1990 | Sawyer et al. . | |
| 4,955,925 | * | 9/1990 | Platti | 15/257.6 |
| 4,979,547 | | 12/1990 | Hoerner . | |
| 5,065,965 | | 11/1991 | Aulabaugh . | |
| 5,080,308 | | 1/1992 | Franks . | |
| 5,090,756 | * | 2/1992 | Pfisterer | 294/1.1 |
| 5,129,609 | | 7/1992 | Tobin . | |
| 5,147,102 | * | 9/1992 | Dyer, Jr. | 294/152 |
| 5,163,278 | | 11/1992 | Martenhoff et al. . | |
| 5,180,125 | | 1/1993 | Caveney . | |
| 5,211,434 | * | 5/1993 | Lanava | 294/1.1 |
| 5,271,589 | | 12/1993 | Belous . | |
| 5,285,988 | | 2/1994 | Bogren . | |
| 5,292,093 | | 3/1994 | Shumake . | |
| 5,337,947 | * | 8/1994 | Eskandry | 229/115 |
| 5,393,022 | | 2/1995 | Palumbo . | |
| 5,716,033 | | 2/1998 | Gibson . | |
| 5,878,461 | * | 3/1999 | Killian | 15/257.1 |
| 5,879,039 | | 3/1999 | Baker et al. . | |
| 5,897,084 | | 4/1999 | Judge . | |
| 5,915,768 | | 6/1999 | Young . | |

* cited by examiner

*Primary Examiner*—Steven O. Douglas
*Assistant Examiner*—Peter de Vore
(74) *Attorney, Agent, or Firm*—Coats & Bennett, P.L.L.C.

(57) ABSTRACT

A yard debris transportation device includes a multi-panel assembly that is moveable between a collection configuration and a transport configuration. The panel assembly includes first, second, third, and fourth panel sections that are hingeably connected in series. In the collection configuration, the panel sections are open and substantially flat, such as laying against the ground. After yard debris is placed thereon, the panel assembly is changed to the transport configuration, forming a shell about a cavity having the yard debris therein. The end panel sections overlap in the transport configuration so that cutouts on the end panel sections overlay one another, thereby forming at least one gripping hole. The gripping hole(s) are used as a handle to carry the panel assembly with the yard debris trapped therein from the collection location to the remote dumping location. The panel assembly is inserted into a trash bag and the gripping hole(s) is released. With the panel assembly at least partially opened from the transport position, yard debris flows out the lower opening of the panel assembly and into the trash bag. The panel assembly may then be easily carried to the same collection site or a new collection site.

14 Claims, 4 Drawing Sheets

MULTI-FUNCTION TRANSPORTER FOR YARD DEBRIS

BACKGROUND OF THE INVENTION

The present invention relates to the field of collecting yard debris in flexible containers, and more particularly to a new and useful method and means of collecting and transporting yard debris for disposal in plastic trash bags.

The conventional plastic trash bag, normally formed of thin, flexible plastic such as low density polyethylene, is commonly used for a variety of trash receptacle functions around the home. The widespread acceptance and use of such flexible plastic trash bags evidence their basic practicality notwithstanding the difficulty of filling the flexible and flaccid trash bags with trash.

One of the more common uses of trash bags, particularly in larger sizes, is the collection of leaves, lawn and garden clippings, or the like ("yard debris"). The flexibility of the trash bags is sometimes a hindrance in such uses, and the prior art has seen the development of may types of holding devices for retaining the bags, and particularly the mouths thereof, open in order to receive the debris to be put therein.

Many designs have been proposed for supporting trash bags, such as those shown in U.S. Pat. No. 4,037,778 to Boyle; U.S. Pat. No. 4,940,200 to Sawyer et al., and U.S. Pat. No. 4,979,547 to Hoerner. While these designs may support the trash bag itself, and may facilitate the routing of the yard debris into the trash bag, both with varying degrees of success, they do not make the task of collecting the yard debris and carrying it to a remotely-located trash bag any easier. Thus, these designs have not proven completely satisfactory.

Other designs have been proposed for collection devices that incorporate a trash bag, such as those shown in U.S. Pat. No. 3,936,087 to Alexander; U.S. Pat. No. 4,521,043 to Wilsford; U.S. Pat. No. 4,749,011 to Rylander; U.S. Pat. No. 4,760,982 to Cooke; U.S. Pat. No. 4,884,603 to Simpson; and U.S. Pat. No. 5,065,965 to Aulabaugh. However, these devices have proven difficult to use in some circumstances. For instance, it may be desirable to leave the trash bag at a certain location, such as curbside, while allowing the yard debris to be separately collected and conveniently transported to the location of the trash bag. The combined devices are obviously incapable of operating in such a fashion.

As such, there remains a need for an improved yard debris transport device and a method of using the same. Such a device should preferably allow the yard debris to be collected at one location and thereafter carried to another location and deposited in a conventional plastic or paper trash bag.

SUMMARY OF THE INVENTION

The improved yard debris transportation device of the present invention utilizes a multi-panel assembly that is moveable between a collection configuration and a transport configuration. One preferred embodiment of the present invention includes a panel assembly having at least first, second, third, and fourth panel sections that are hingeably connected in series. In the collection configuration, the panel sections are open and substantially flat, such as laying against the ground. After yard debris is placed thereon, the panel assembly is changed to the transport configuration, forming a shell about a cavity having the yard debris therein. The end panel sections overlap in the transport configuration so that cutouts on the end panel sections overlay one another, thereby forming at least one gripping hole. The user uses the gripping hole as a handle to carry the panel assembly with the yard debris trapped therein from the collection location to the remote dumping location. In preferred embodiments, only one gripping hole is used during transport, allowing the panel assembly with the yard debris trapped therein to be transported with only one hand, leaving the user's other hand free for other activities. The panel assembly is inserted into a trash bag and the gripping hole released. Because the yard debris is under compression within the cavity formed by the panel assembly, the yard debris supplies a biasing action to open the panel assembly when the user releases their grip thereon. With the panel assembly at least partially opened from the transport position, the user pulls the panel assembly up and out of the trash bag, with the yard debris flowing out the lower opening of the panel assembly and into the trash bag. In some embodiments, the panel assembly may further be partially pistoned in and out of the trash bag to compact the yard debris adjacent the trash bag's inner surface. The panel assembly may then be easily carried to the same collection site or a new collection site. Thus, the present invention supplies a yard debris transport device that may be used to simplify the yard debris collection process.

DETAILED DESCRIPTION OF THE PREFERRED EMBODIMENT(S)

Figure 1:
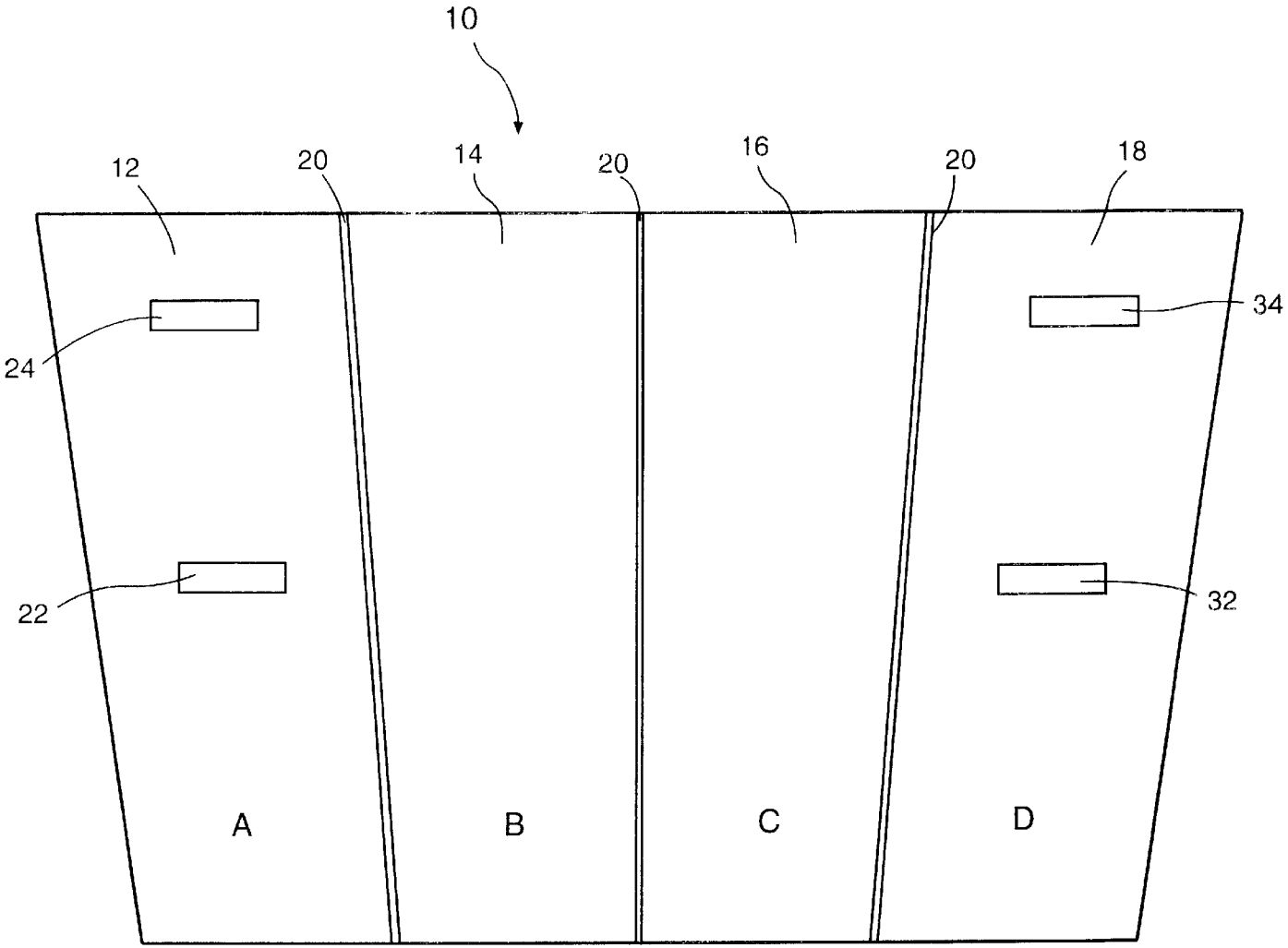
FIG. 1 is a top view of one embodiment of the panel assembly of the present invention in the collection configuration.

The present invention utilizes a folding panel assembly 10 selectively moveable between a collection configuration and a transport configuration. One example of a suitable panel assembly 10 is shown in FIG. 1. The panel assembly 10 includes a plurality of panel sections, such as the four panel sections 12,14,16,18 shown in FIG. 1. For ease of reference, the panel sections are labeled panel A, B, C, and D. The panel sections 12,14,16,18 are preferably generally planar, so as to lay flat when the panel assembly 10 is fully opened. The panel sections 12,14,16,18 may have any convenient shape; however, they preferably have a quadrilateral perimeter. In some embodiments, the panel sections 12,14,16,18 may be rectangular; however in preferred embodiments, the panel sections 12,14,16,18 have a trapezoidal perimeter, as shown in FIG. 1. That is, the panel sections 12,14,16,18 preferably taper from "top" to "bottom." It is preferred that the end panel sections 12,18 have the same, or at least substantially similar, overall shape. Further, it is preferred that the intermediate panel sections 14,16 have the same, or at least substantially similar, overall shape. Indeed, in some embodiments, the panel sections 12,14,16,18 may have identical outer perimeter shapes. The two end panel sections 12,18 preferably include at least one respective cutout 22,32 in a middle portion thereof, as shown by panel A and panel D of FIG. 1. Optionally, the end panel sections 12,18 may include more than one set of cutouts, such as a second set of cutouts 24,34.

The panel sections 12,14,16,18 may be made from a wide variety of materials, including corrugated cardboard, plastic, and the like. Preferably, the surfaces of the panel sections 12,14,16,18 are coated or impregnated with a water resistant material, such as wax, if the base material of the panel sections 12,14,16,18 is not water resistant so as to prolong life in the face of exposure to wet yard debris.

Adjacent panel sections 12,14,16,18 are connected via hinged connections 20. These hinges 20 may of any type known in the hinge art. For instance, the hinge portions 20 may be integrally formed with the panel sections 12,14,16, 18 and a rod (not shown) extended therethrough. Another alternative is to use a sturdy tape material, such as common duct tape. Further still, the hinges 20 may be formed as decreased thickness sections between panel sections 12,14, 16,18 of a unitary panel assembly 10. While it is preferred that the hinges 20 extend the length of the adjacent panels sides, as shown in FIG. 1, this is not required. Indeed, the present invention may function if the hinges 20 are substantially shorter that the corresponding sides of the panel sections 12,14,16,18, but this is not preferred.

Figure 2:
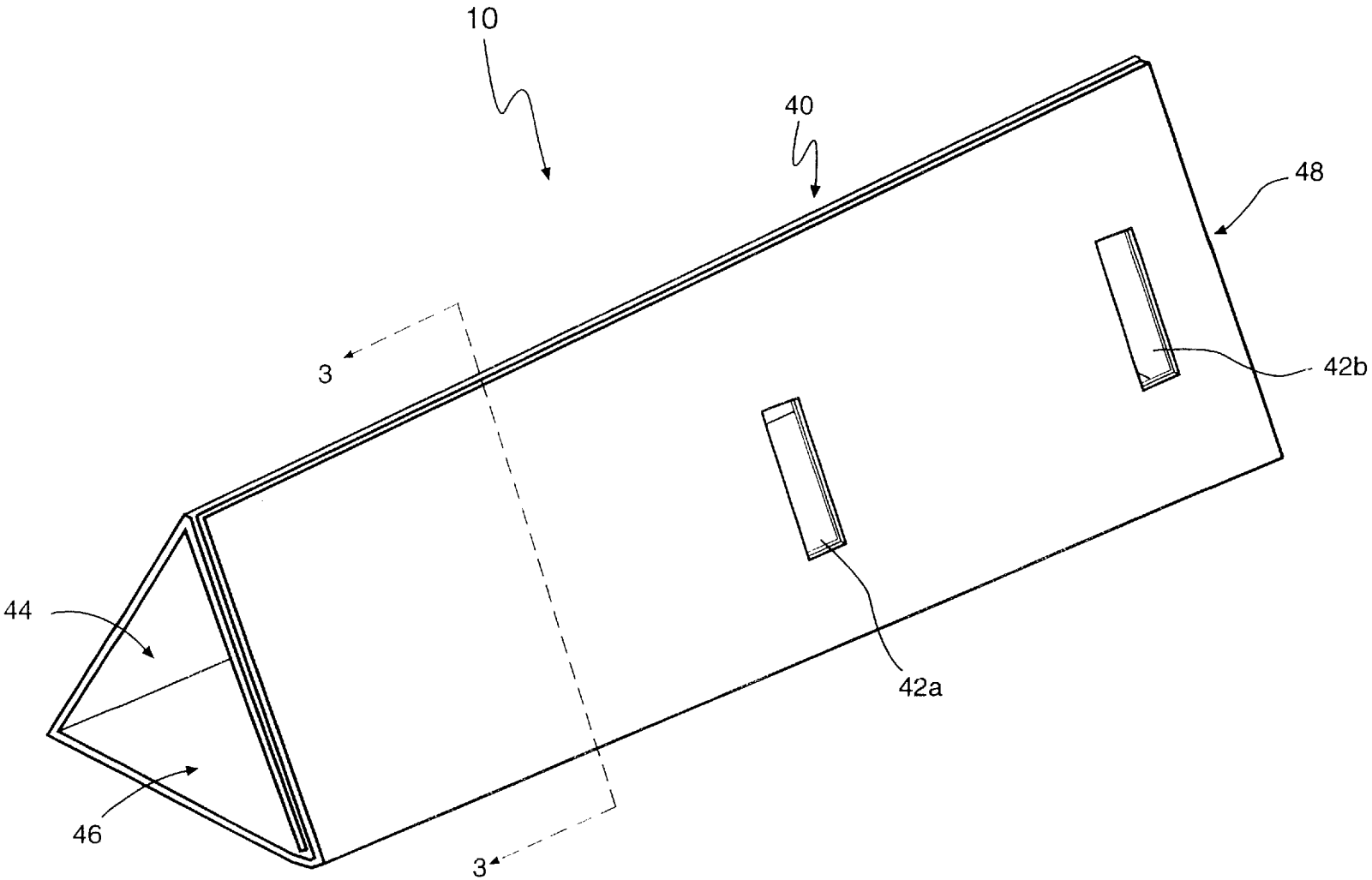
FIG. 2 is a perspective view of the panel assembly of FIG. 1 in the transport configuration.
Figure 3:
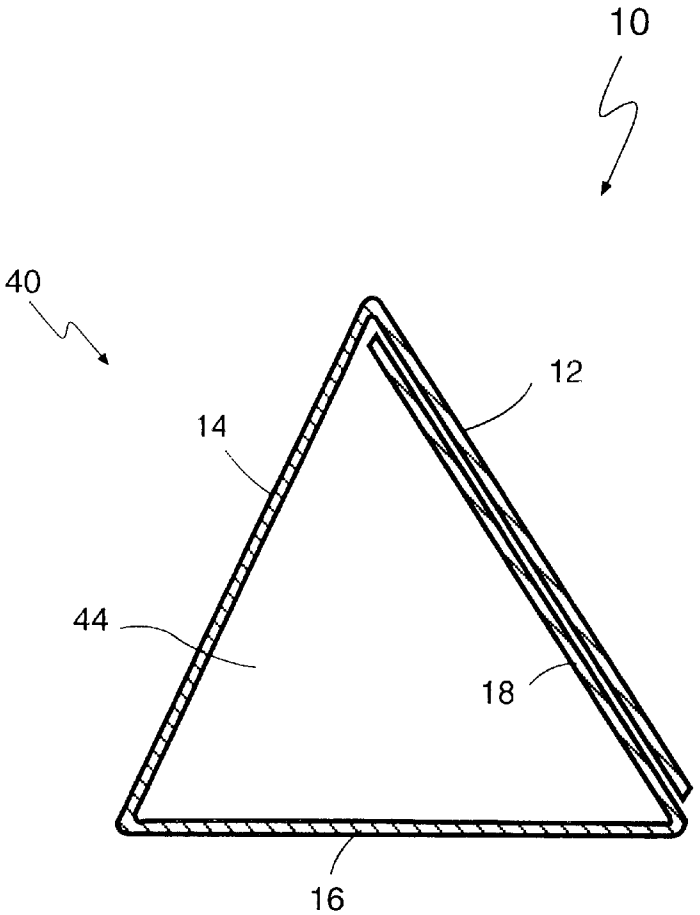
FIG. 3 is a cross-sectional view along lines 3—3 of FIG. 2.

The panel assembly 10 is moveable between a collection configuration, shown in FIG. 1, and a transport configuration, shown in FIG. 2. In the collection configuration, the panel sections 12,14,16,18 lay substantially flat with respect to one another. This collection configuration allows the panel assembly 10 to be placed on a relatively flat surface, such as a flat area in a yard, so as to facilitate the placement of yard debris thereon. The panel sections 12,14,16,18 may be folded together to form the transportation shell 40 shown in FIG. 2. In this transportation configuration, the cutouts 22,32 (and optionally 24,34) in the end panel sections 12,18 (labeled A and D in FIG. 1) overlap so as to form gripping hole 42*a* (and optionally 42*b*). In the transportation configuration, the panel assembly 10 forms a shell 40 having a central cavity 44. See FIG. 3. The cavity 44 is open on the respective ends 46,48, but circumferentially enclosed by the shell 40.

Figure 4:
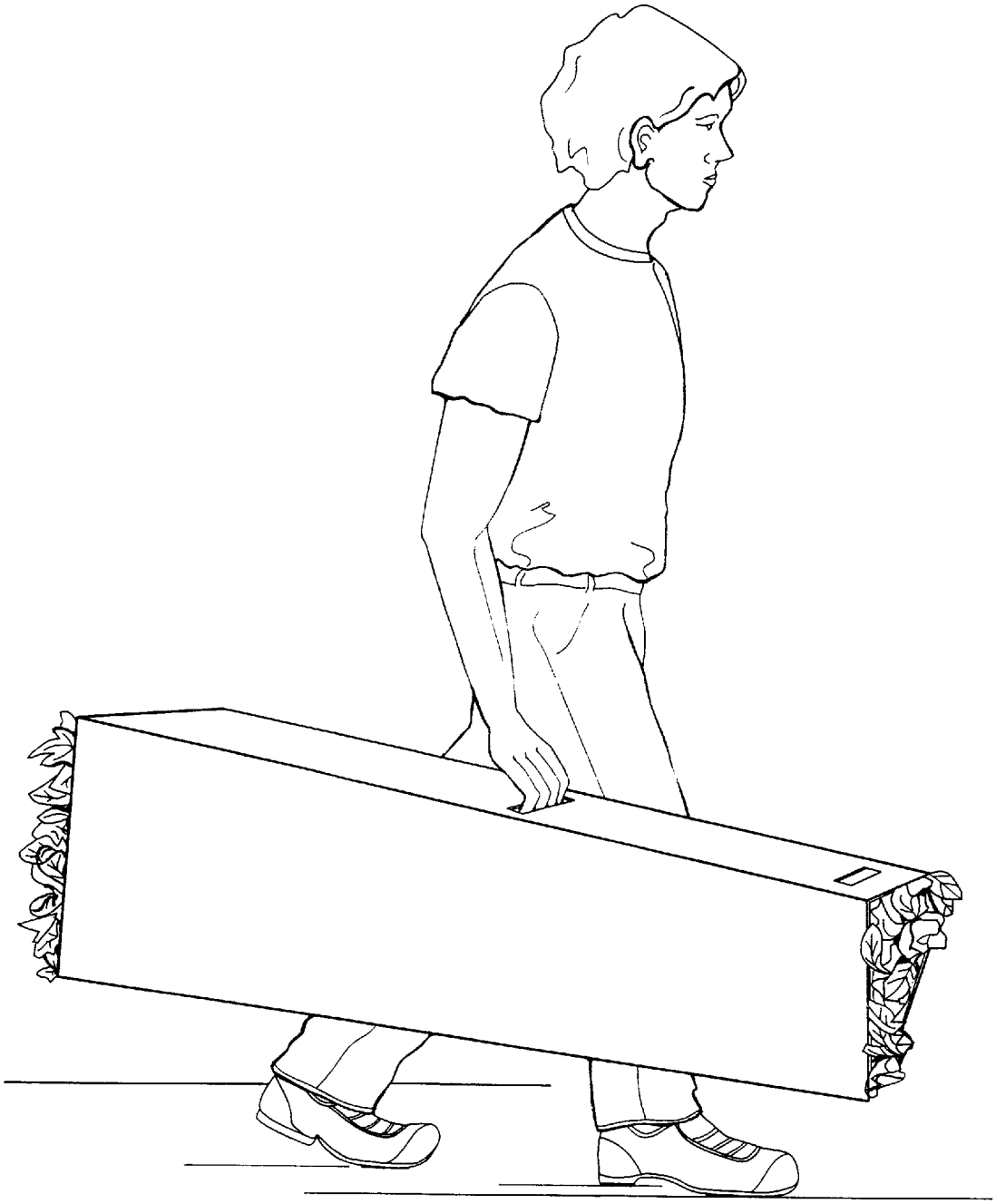
FIG. 4 shows the panel assembly in the transport configuration filled with yard debris and being carried by a user with one hand.

In use, the panel assembly 10 is laid out in the collection configuration on the ground. Yard debris is raked onto or otherwise collected on the middle portion of the panel assembly 10. For instance, a mound of leaves may be formed that substantially overlies panels B and C. When sufficient quantity of yard debris is collected, the panel assembly 10 may be folded into the transport configuration by lifting the end panels 12,18 and moving them so that they overlap. In this manner, yard debris is trapped in the cavity 44 formed by the panel assembly 10. The leaves, etc. are preferably circumferentially compressed by the panel assembly 10. This compressive force helps generate sufficient friction to contain the yard debris during subsequent transport. With the panel assembly 10 in the transport configuration, the user may lift and carry the assembly 10 by using gripping hole 42 formed by the overlapping cutouts 22,32 as a handle. As discussed above, the cutouts 22,32 are preferably located at or near the midpoint of their respective panels 12,18 so that the gripping hole 42*a* formed thereby may be at or near the midpoint of the combined load of the panel assembly 10 and the yard debris contained therein. Thus the panel assembly 10 and the yard debris may be balanced and carried by the user in the transportation configuration from the collection location to the location of the trash bag (the "dumping location"). See FIG. 4. In those embodiments that include the optional cutouts 24,34 near end 48, the additional gripping hole 42*b* formed thereby may also be used for unusually heavy loads if necessary. However, it is believed that hole 42*a* should be sufficient for most loads, including all loads less than about forty pounds.

Upon arrival at the dumping location, one end of the panel assembly 10 is inserted into the open end of the trash bag. For ease of reference, this inserted end is called the lower end and the opposite end of the panel assembly 10 is called the upper end. It should be noted that it is possible that the lower end may be physically higher than the upper end, but this would be unusual. Preferably, the narrower end 46 of the panel assembly 10, if there is one, is the lower end. Once the panel assembly 10 is inserted, the trash bag should be pulled up around the sides of the panel assembly 10 and gripping hole 42*a* released. Because the yard debris is under compression within the cavity 44, the yard debris supplies a biasing action to open the panel assembly 10 when the user releases their grip thereon. With the panel assembly 10 at least partially opened from the transport position, the user may pull the panel assembly 10 up and out of the trash bag using cutouts 24,34, with the yard debris flowing out the lower end opening 46 of the panel assembly 10 and into the trash bag. The panel assembly 10 may then be easily carried to the same collection site or a new collection site.

As part of the dumping process, the user may optionally shake the panel assembly 10 to promote the removal of the yard debris therefrom. In addition, the panel assembly 10 may be used to compress yard debris within the trash bag, if appropriate. As discussed above, the yard debris within the cavity 44 provides a biasing action to open the panel assembly 10 when the user releases their grip thereon. Preferably this biasing action forces the panels 12,14,16,18 of the panel assembly 10 against the interior surface of the trash bag. The panel assembly 10 may then be pistoned up and down, preferably by gripping cutouts 24,34, to force the yard debris adjacent to the interior surface of the trash bag into a compressed state. The frictional force between the trash bag and the yard debris should then hold this material in place. Thus, the panel assembly 10 of the present invention may be used to collect, transport, and compact yard debris.

When the yard debris collection and transportation is complete, the panel assembly 10 may be folded for storage. Preferably, the panel sections 12,14,16,18 accordion fold into a compact storage configuration, having a footprint of little more than a single panel section, but this is not required. Alternatively, the panel assembly 10 may be folded in half at its midpoint so that panels A and B overlay panels C and D, and the cutouts 22,32 overlap. In this arrangement, the folded panel assembly 10 may hung on a nail similar device by passing the overlapping cutouts 22,32 thereover.

The panel assembly 10 discussed above included four panel sections 12,14,16,18. These four panel sections, in the transport configuration, formed a shell 40 roughly having a triangular cross-section. See FIG. 3. While such a design is believed most practical, the present invention is not limited to four panel sections. Instead, any number of panel sections from four and up may be used. With more than four panel sections, the cross sectional shape of the cavity 44 will obviously vary. Preferably, the cross sections are substantially regular polygons, but this is not required. Further, it is within the present invention for more than two panels to overlap, provided the panel assembly 10 forms a cavity 44 in the transport configuration.

Further, the discussion above has been in terms of panel sections 12,14,16,18 having continuous surfaces. This is preferred so as to discourage rake tines form being entangled with the panel sections. However, the panel sections 12,14, 16,18 may alternatively be formed of a lattice or other discontinuous construction, such as fabric netting. In such embodiments, the perimeters of the panel sections 12,14,16, 18 are preferably a relatively rigid material so as to supply structural integrity. Further, the deformation of the center portion of the panel sections should be limited so as to promote compression of the yard debris in the cavity 44 of the transport configuration.

A conventional plastic trash bag has been used as an illustrative example of a debris receptacle. However, it is to be understood that the invention is not limited to use only with trash bags, but instead encompasses all forms of trash receptacles, including without limitation paper bags, plastic bags, stationary bins, portable bins and carts, and the like. Likewise, many embodiments of the present invention may be used to transport yard debris from one location to a dumping location that does not have a debris receptacle per se, such as with an unconfined compost pile, an unconfined leaf pile destined for burning, and the like.

The use of the panel assembly 10 allows leaves and other yard debris to be easily collected at one location and carried to another location. The panel structure allows the panel assembly 10 to be easily converted from the collection configuration into the transport configuration. Also, the panels forming the cavity 44 help circumferentially contain the yard debris during transport; in addition, the polygonal configuration of the panels in the preferred embodiments applies a compressive force to the yard debris, thereby lessening the chance that the yard debris will fall out of the open ended cavity 44 during transport. Thus, the present invention provides a simple to use, but robust, device for transporting yard debris from one location to another, one that does not need a trash bag attached to function properly. Further, preferred embodiments of the present invention also provides a convenient means to compact the yard debris within the trash bag . Thus, preferred embodiments of the panel assembly 10 of the present invention may be used to collect, transport, and compact yard debris.

The present invention may, of course, be carried out in other specific ways than those herein set forth without departing from the spirit and essential characteristics of the invention. The present embodiments are, therefore, to be considered in all respects as illustrative and not restrictive, and all changes coming within the meaning and equivalency range of the appended claims are intended to be embraced therein.

What is claimed is:

1. A method of collecting and disposing of yard debris, comprising:

a) arranging a panel assembly having at least a first generally planar end panel, a second generally planar end panel, and at least two intermediate generally planar panels linking said first end panel to said second end panel in a collection configuration wherein at least said intermediate panels are disposed substantially flat along a ground surface, said panel assembly including a first cutout disposed within one of said end panels and a second cutout disposed within another of said panels;

b) moving yard debris onto said panel assembly;

c) thereafter, folding said panel assembly into a transport configuration substantially circumferentially surrounding said yard debris in a longitudinal cavity defined by at least three of said panels and having a substantially polygonal cross-section; wherein, in said transport configuration, said first and second cutouts substantially overlap to form a first gripping hole;

d) carrying, via said first gripping hole, said panel assembly with said yard debris to a remote location;

e) thereafter, dumping said yard debris from said panel assembly at said remote location.

2. The method of claim 1 wherein said longitudinal cavity includes a lower opening and an upper opening disposed at respective ends thereof and wherein said dumping includes inserting said panel assembly into a trash bag, lower-opening end first.

3. The method of claim 2 wherein said intermediate panels include a first end corresponding to said upper opening and a second end corresponding to said lower opening and wherein the width of said intermediate panels tapers in the direction from said first end towards said second end.

4. The method of claim 1 wherein said dumping further includes releasing said gripping hole after said inserting.

5. The method of claim 4 further including orienting said longitudinal cavity within at least 45° of vertical prior to said releasing.

6. The method of claim 4 wherein said dumping further includes shaking said panel assembly substantially along the length of said longitudinal cavity after said releasing.

7. The method of claim 1 wherein, in said collection configuration, said first and second end panels, and said intermediate panels, are disposed substantially flat along a ground surface.

8. The method of claim 1 including dumping said yard debris from said panel assembly into a trash bag at said remote location.

9. The method of claim 8 wherein said dumping further includes supporting said trash bag with said panel assembly from the inside of said trash bag.

10. The method of claim 1 wherein, in said transport configuration, said panel assembly circumferentially surrounds said yard debris and applies a compressive force thereto.

11. The method of claim 1 wherein, in said transport configuration, said longitudinal cavity includes first and second uncovered ends.

12. The method of claim 1 wherein said panel assembly further includes a third cutout disposed within the same end panel as said first cutout, and further including a fourth cutout disposed within the same panel as said second cutout, and wherein, in said transport configuration, said third and fourth cutouts substantially overlap to form a second gripping hole, and further including carrying, via said first and second gripping holes, said panel assembly with said yard debris to a remote location prior to said dumping.

13. A method of collecting and disposing of yard debris, comprising:

a) arranging a panel assembly having first and second generally planar end panels and at least two intermediate generally planar panels linking said first end panel to said second end panel in a collection configuration wherein said panels are disposed substantially flat along a ground surface, said panel assembly including a first cutout disposed within said first end panel and a second cutout disposed within said second end panel;

b) moving yard debris onto said panel assembly;

c) thereafter, folding said panel assembly into a transport configuration substantially circumferentially surrounding said yard debris in a longitudinal cavity defined by at least three of said panels and having a substantially polygonal cross-section; wherein, in said transport configuration, said first and second cutouts substantially overlap to form a first gripping hole; said cavity including a lower opening and an upper opening disposed at respective ends thereof;

d) applying a compressive force to said yard debris in said cavity;

e) carrying, via said first gripping hole, said panel assembly with said yard debris to a remote location;

f) thereafter, dumping said yard debris from said panel assembly, said dumping including:

i) inserting said panel assembly into a trash bag lower-opening end first, ii) releasing said gripping hole after said inserting;

iii) spreading said fourth panel away from said first panel after said releasing.

14. The method of claim 13 wherein said panel assembly further includes a third cutout disposed within said first end panel and a fourth cutout disposed on said second end panel, and wherein, in said transport configuration, said third and fourth cutouts substantially overlap to form a second gripping hole, and further including carrying, via said first and second gripping holes, said panel assembly with said yard debris to a remote location prior to said dumping.

* * * * *